US006142819A

United States Patent [19]

Norizuki et al.

[11] Patent Number: 6,142,819

[45] Date of Patent: Nov. 7, 2000

[54] PRESSURE-CONTACT TERMINAL AND METHOD FOR CONNECTING SUCH A PRESSURE-CONTACT TERMINAL TO A COVERED ELECTRIC WIRE

[75] Inventors: Teruhisa Norizuki; Yuji Hatagishi, both of Shizuoka, Japan

[73] Assignee: Yazaki Corporation, Tokyo, Japan

[21] Appl. No.: 09/090,150

[22] Filed: Jun. 4, 1998

[30] Foreign Application Priority Data

Jun. 6, 1997 [JP] Japan ..... 9-149559

[51] Int. Cl.[7] ..... H01R 4/24; H01R 4/26; H01R 11/20

[52] U.S. Cl. ..... 439/397; 439/439

[58] Field of Search ..... 439/397, 399, 439/400, 401, 406, 439, 440, 441, 459

[56] References Cited

U.S. PATENT DOCUMENTS

| | | | |
|---|---|---|---|
| 4,940,425 | 7/1990 | Hass et al. | 439/397 |
| 4,983,130 | 1/1991 | Caveney et al. | 439/407 |
| 5,133,672 | 7/1992 | Nelligan, Jr. et al. | 439/399 |
| 5,756,972 | 5/1998 | Vranicar et al. | 439/459 |

FOREIGN PATENT DOCUMENTS

| | | |
|---|---|---|
| 197 34 476 | 3/1998 | Germany . |
| 7-22468 | 4/1995 | Japan . |

*Primary Examiner*—Lincoln Donovan
*Assistant Examiner*—Javaid Nasri
*Attorney, Agent, or Firm*—Sughrue, Mion, Zinn, Macpeak & Seas, PLLC

[57] ABSTRACT

In a pressure-contact terminal, a pair of pressure-contact blades are bent in such a manner that they are inclined with respect to their respective side walls of the terminal. A covered electric wire is inserted into between the side walls to thereby allow the pressure-contact blades to bite the covered electric wire. After then, the covered electric wire is pulled backwardly to thereby change the inclination angles of the pressure-contact blades greatly and, while the covered electric wire remains pulled backwardly, a clamping portion formed in the terminal is clamped to thereby fix the covered electric wire. By increasing the inclination angles of the pressure-contact blades, the pressure-contact blades can be contacted with a core included in the covered electric wire with a high contact load.

7 Claims, 6 Drawing Sheets

PRESSURE-CONTACT TERMINAL AND METHOD FOR CONNECTING SUCH A PRESSURE-CONTACT TERMINAL TO A COVERED ELECTRIC WIRE

BACKGROUND OF THE INVENTION

1. Field of the Invention

The present invention relates to a pressure-contact terminal including pressure-contact blades to be pressure-contacted with a covered electrical wire and a method for connecting a pressure-contact terminal to a covered electric wire.

2. Description of the Related Art

FIG. 6 is a perspective view of a conventional pressure-contact terminal which is disclosed in Japanese Utility Model Unexamined Publication No. Hei. 7-22468. This pressure-contact terminal includes a contact portion 1 into which a mating terminal is inserted, a pressure-contact portion 2 with which a covered electric wire can be pressure-contacted, and a clamping portion 3 for fixing the covered electric wire. The pressure-contact portion 2 includes a pair of pressure-contact blades 5 which are provided in a pair of right and left side wall portions 4 thereof respectively; that is, if a covered electric wire is inserted into between the two side wall portions 4, then the two pressure-contact blades 5 respectively bite the covering portion of the covered electric wire inserted and can be thereby contacted with a core embedded in the covered electric wire, so that the pressure-contact portion 2 or the pressure-contact terminal is allowed to conduct. In this structure, as described above, because the covered electric wire is inserted between and is pressure-contacted with the pressure-contact blades 5, a gap between the pressure-contact blades 5 (which is generally referred to as a pressure-contact slot) can be spread out easily, and such spread-out of the pressure-contact blades 5 results in the poor contact of the pressure-contact blades 5 with respect to the core of the covered electric wire. In view of this, in the present conventional pressure-contact terminal, a lower end portion 5*a* of each of the pressure-contact blades 5 is formed in a waved shape and the waved lower end portion 5*a* is connected to a bottom wall portion 6 of the present pressure-contact terminal. The waved, lower end portions 5*a* can be flexed and restored when the covered electric wire is pressure-contacted with the pressure-contact blades 5, thereby preventing the pressure-contact blades 5 from spreading out.

Now, FIG. 7 is a developed view of the present conventional pressure-contact terminal, showing how to manufacture the same; that is, the pressure-contact terminal shown in FIG. 6 can be manufactured by punching out a conductive plate material by a press and then bending the punched-out plate. In FIG. 7, reference character 7 designates the portion of the conductive plate where the pressure-contact blades 5 is made, and 8 designates the portion of the conductive plate where the waved lower end portions of the waved pressure-contact blades 5 is made.

Now, FIGS. 8 and 9 respectively show another conventional pressure-contact terminal, in which two pressure-contact blades 5 are respectively formed in the two ends of each of a pair of right and left side wall portions 4. These pressure-contact blades 5 are formed by bending the two end portions of each of the side wall portions 4. There are recessed portions 4*a* formed in the lower end portion of each of the side wall portions 4 to provide a strength, thereby preventing the side wall portions 4 from spreading out. According to this conventional pressure-contact terminal, as shown in FIG. 9, when a covered electric wire 9 is inserted, the pressure-contact blades 5 bite the covered electric wire 9 for connection thereto, and, by clamping a clamping portion 3 of the present pressure-contact terminal, the covered electric wire 9 is fixed.

As described above, in either of the conventional pressure-contact terminals, there is necessary a structure which can prevent the pressure-contact blades 5 from spreading out easily, with the result that the shape of the pressure-contact terminal is complicated. This not only increases the number of pressing steps of manufacturing the pressure-contact terminal but also makes a metal mold complicated in shape, which results in the troublesome manufacture of the pressure-contact terminal. Also, even use of such a complicated structure is not always be sure to prevent the pressure-contact blades 5 from spreading out, and thus there still remains a fear that the contact of the pressure-contact terminal with the covered electric wire can be made poor due to the spread-out pressure-contact blades thereof, thereby worsening the electric reliability of the pressure-contact terminal.

SUMMARY OF THE INVENTION

In view of the above, it is an object of the invention to provide a pressure-contact terminal which is simple in structure and permits the pressure-contact blades thereof to bite the core of a covered electric wire positively to thereby be able to enhance the electric reliability thereof. Also, it is another object of the invention to provide a method for connecting such a pressure-contact terminal to an electric wire.

In attaining the above object, according to the invention, there is provided a pressure-contact terminal comprising: a pair of side wall portions between which a covered electric wire including a core covered with an insulating covering portion is inserted; and pressure-contact blades respectively formed by bending in the side wall portions and structured such that, when the covered electric wire is pressure-contacted therewith, they bite the covering portion of the covered electric wire and are thereby contacted with the core of the covered electric wire, wherein the pressure-contact blades are bent in such a manner that they are inclined with respect to the side wall portions respectively, and angles of the pressure-contact blades can be changed in a direction where inclination angles thereof increase.

According to the invention, there is further provided a method for connecting a pressure-contact terminal and a covered electric wire to each other, comprising the steps of: inserting a covered electric wire including a core covered with an insulating covering portion between a pair of side wall portions of a pressure-contact terminal including inclined and bent pressure-contact blades to thereby allow the pressure-contact blades to bite the covered electric wire; pulling the covered electric wire backwardly with respect to the pressure-contact terminal to thereby change inclination angles of the pressure-contact blades; and clamping a clamping portion of the pressure-contact terminal while the covered electric wire remains pulled backwardly, to thereby fix the covered electric wire to the pressure-contact terminal.

DETAILED DESCRIPTION OF THE PREFERRED EMBODIMENT

Figure 1:
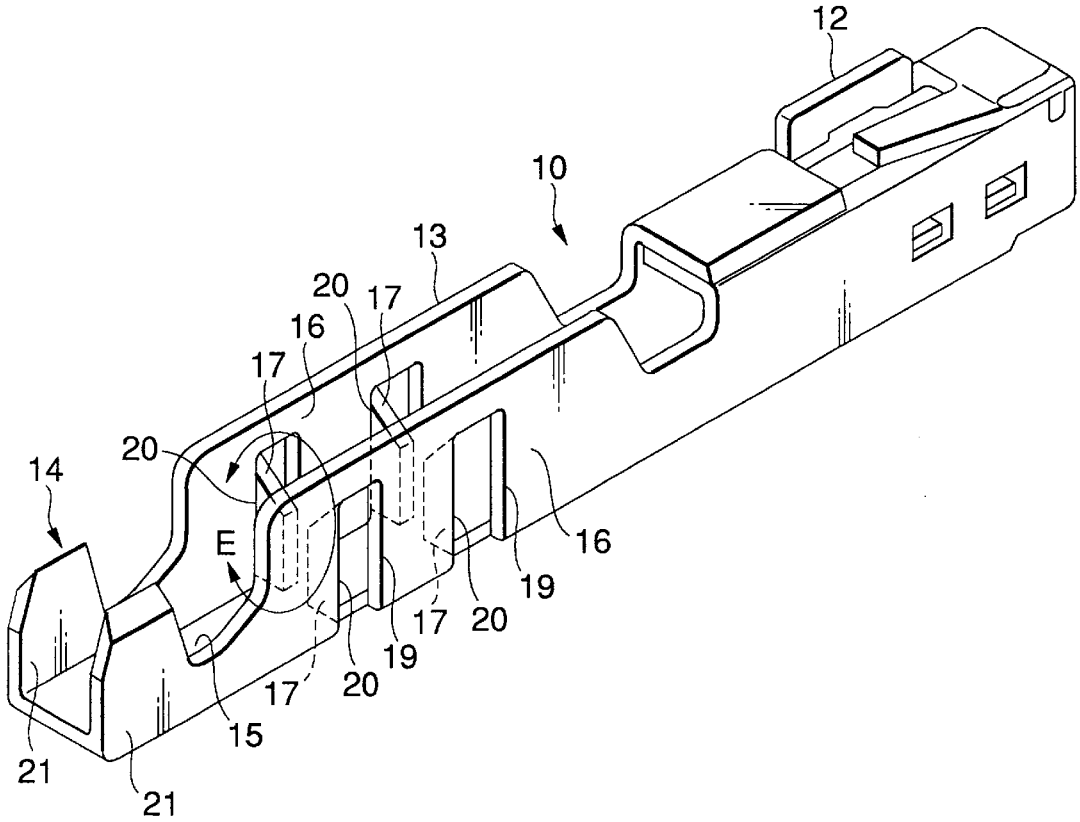
FIG. 1 is a perspective view of an embodiment of a pressure-contact terminal according to the invention.
Figure 2:
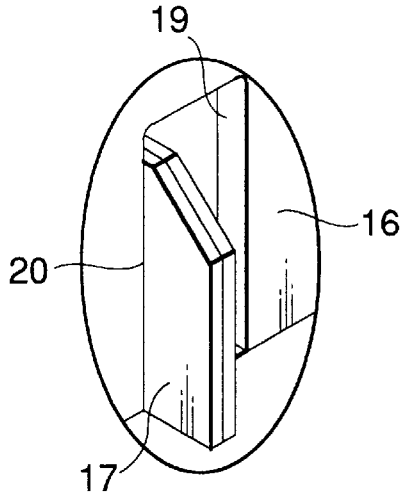
FIG. 2 is an enlarged perspective view of a portion E shown in FIG. 1.
Figure 3:
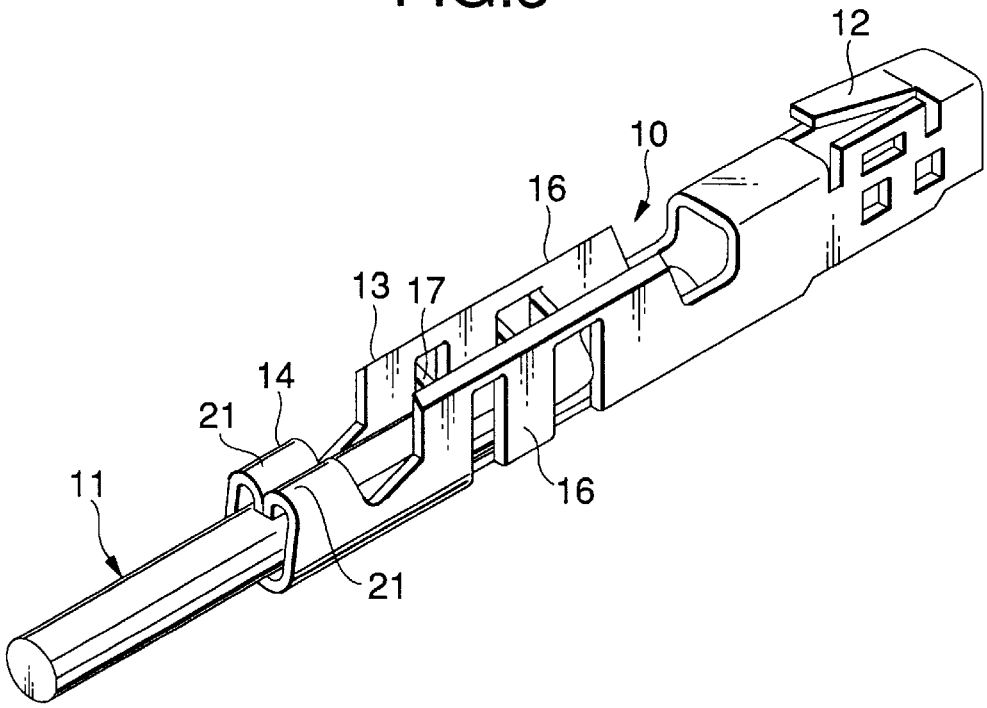
FIG. 3 is a perspective view of the pressure-contact terminal, showing how it is connected to a covered electric wire.
Figure 4:
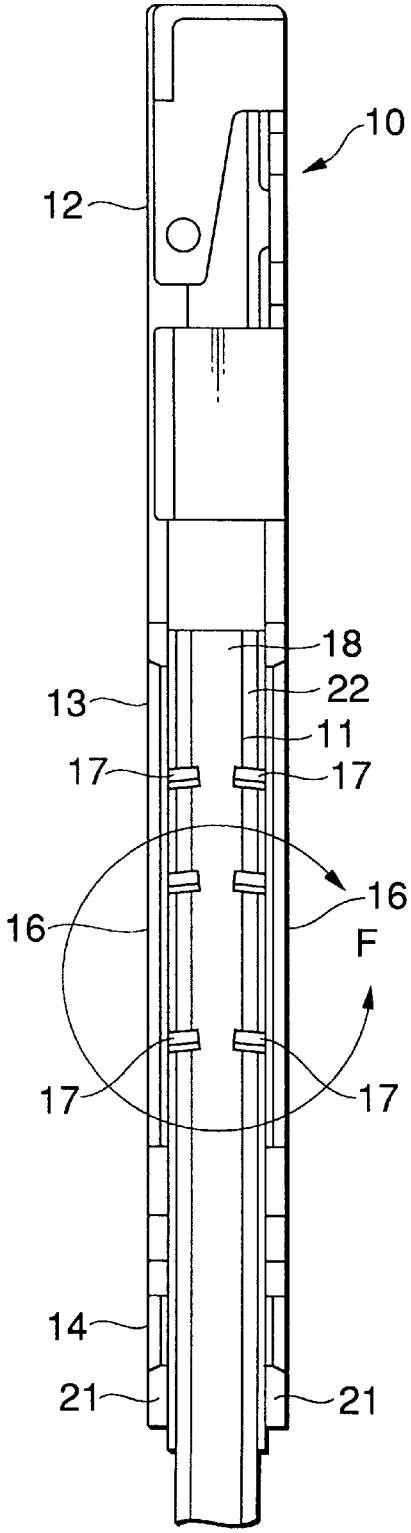
FIG. 4 is a plan view of the pressure-contact terminal, showing how it is connected to the covered electric wire.
Figure 5:
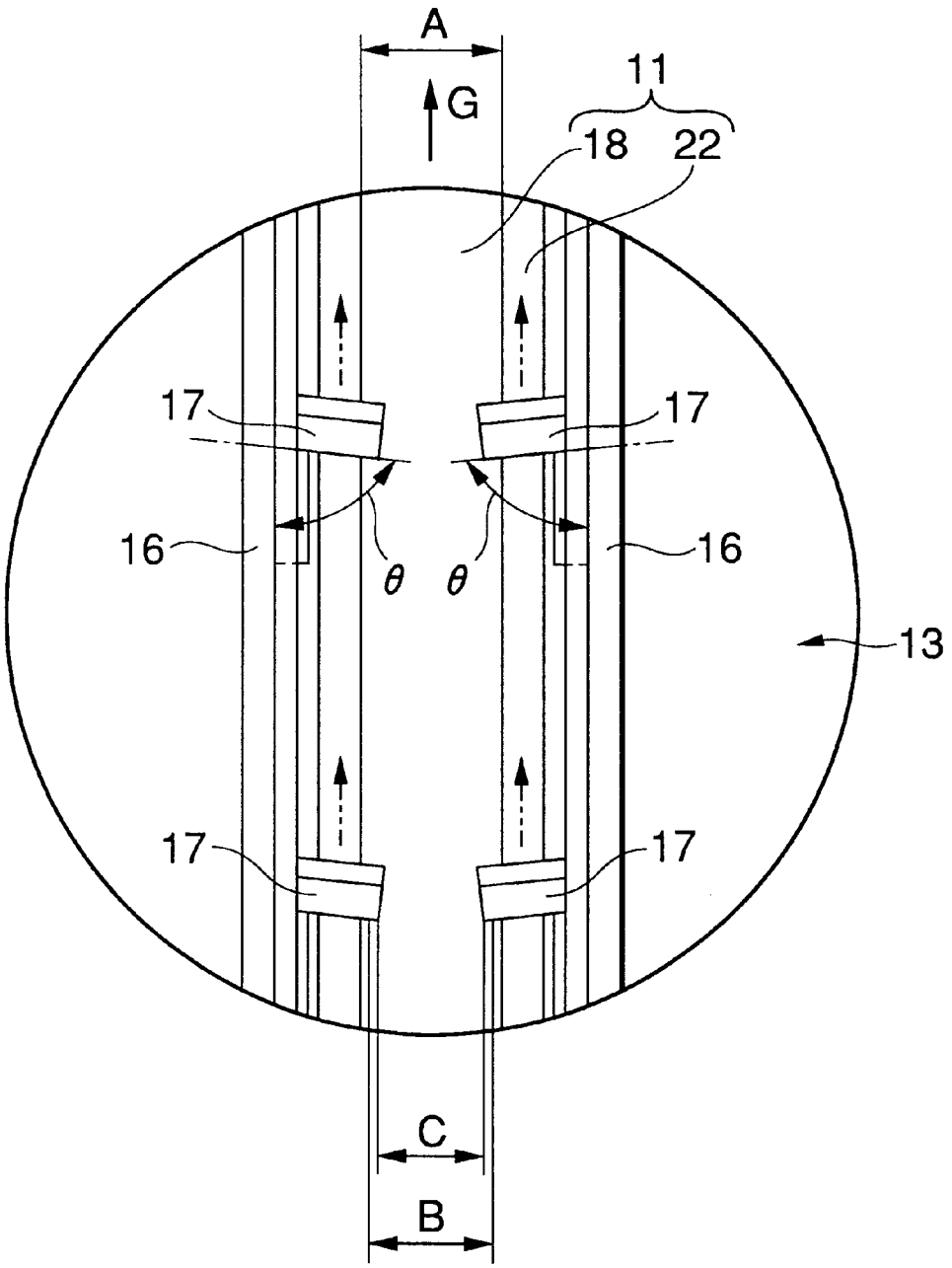
FIG. 5 is an enlarged plan view of a portion F shown in FIG. 4.
Figure 6:
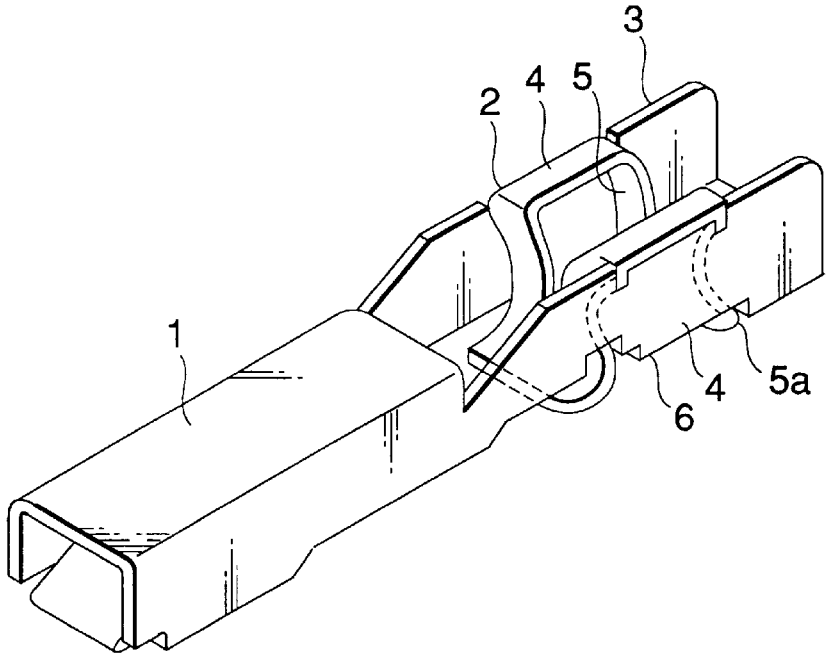
FIG.6 PRIOR ART
FIG. 6 is a perspective view of a conventional pressure-contact terminal.
Figure 7:
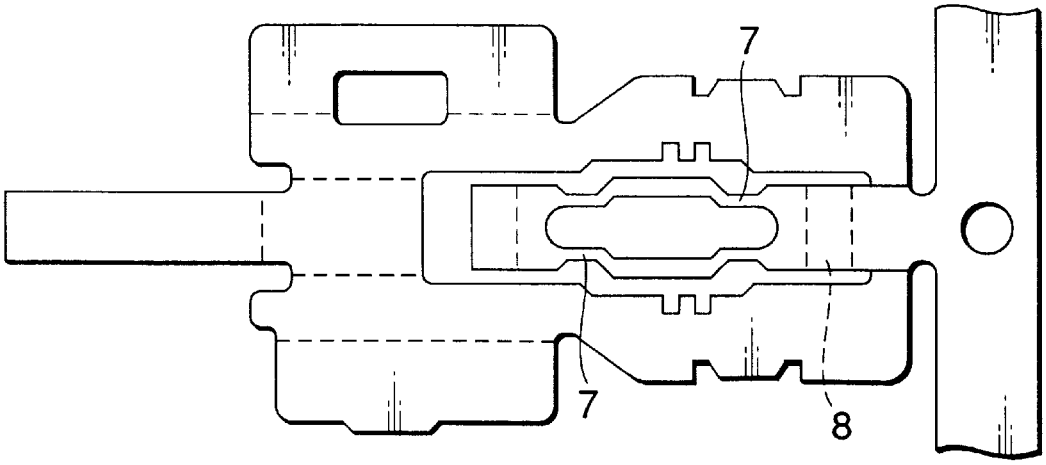
FIG.7 PRIOR ART
FIG. 7 is a developed plan view of the pressure-contact terminal shown in FIG. 6, showing how to manufacture the same.
Figure 8:
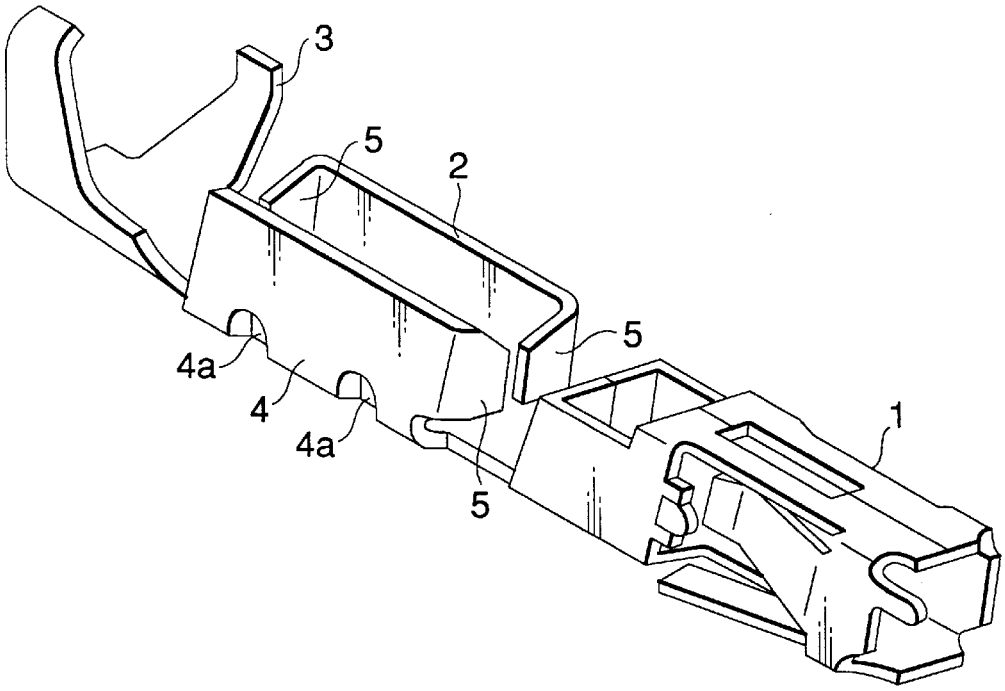
FIG.8 PRIOR ART
FIG. 8 is a perspective view of another conventional pressure-contact terminal.
Figure 9:
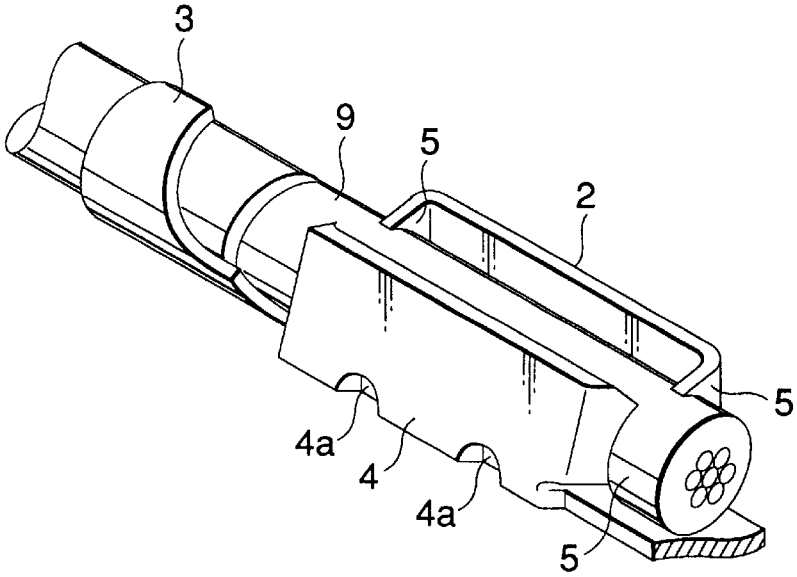
FIG.9 PRIOR ART
FIG. 9 is a perspective view of the pressure-contact terminal shown in FIG. 8, showing how to connect the same.

Now, description will be given below of an embodiment of a pressure-contact terminal according to the invention with reference to FIGS. 1 to 5. In particular, FIG. 1 is a perspective view of a pressure-contact terminal 10 according to an embodiment of the invention; FIG. 2 is an enlarged perspective view of a portion E of the pressure-contact terminal 10 shown in FIG. 1; FIG. 3 is a perspective view of the pressure-contact terminal 10, showing how a covered electric wire 11 is fixed to the pressure-contact terminal 10; FIG. 4 is a plan view of the pressure-contact terminal 10, showing how it is connected to the covered electric wire 11; and FIG. 5 is an enlarged plan view of a portion F of the pressure-contact terminal 10 shown in FIG. 4. The pressure-contact terminal 10 can be formed into such a shape as shown in FIG. 1 by punching out a conductive metal plate and then pressing the punched conductive metal plate. Further, the pressure-contact terminal 10 is structured such that a contact portion 12 thereof is formed in the leading end side thereof, a pressure-contact portion 13 thereof is situated in the rear of the contact portion 12, and a clamping portion 14 thereof is situated in the rear of the pressure-contact portion 13.

The contact portion 12 is formed in a rectangular and cylindrical shape and, if a mating terminal is inserted into the contact portion 12 from the opening portion thereof situated in the leading end thereof, then it can be connected to the mating terminal.

The pressure-contact portion 13 is connected to the contact portion 12 through a bottom wall portion 15. Further, the pressure-contact portion 13 includes a pair of side wall portions 16 and two pairs of pressure-contact blades 17 respectively formed in the side wall portions 16. The pair of side wall portions 16 are formed to stand up from the two sides of the bottom wall portion 15 so that they are opposed to each other and, if a covered electric wire 11 is inserted into and between these two side wall portions 16 from above, then the pressure-contact portion 13 can be connected to the covered electric wire 11.

The pressure-contact blades 17 are structured such that they are able to bite the covered electric wire 11 and they can be thereby contacted with a core 18 included in the covered electric wire 11. The pressure-contact blades 17 can be formed by making cuts in the side wall portions 16 and then raising the cut portions 19 in their mutually approaching directions. The pressure-contact blades 17 are respectively raised with the rear sides (that is, the clamping portion 14 sides) thereof connected to the side wall portions 16, so that they are simple in structure. By the way, reference character 20 designates connecting portions of the pressure-contact blades 17 through which the pressure-contact blades 17 are connected to the side wall portions 16 respectively. Also, the pressure-contact blades 17 are formed in the mutually opposed portions of their respective side wall portions 16 in such a manner as to make a pair, while a gap between the paired pressure-contact blades 17 provides a pressure-contact slot which can be pressure-contacted with the core 18 of the covered electric wire 11.

The pressure-contact blades 17 are cut and raised in such a manner that they are inclined with respect to their respective side wall portions 16. That is, the pressure-contact blades 17 do not extend at right angles to their respective side wall portions 16 but are inclined at a certain angle with respect to their respective side wall portions 16. The direction of inclination of the pressure-contact blades 17, as shown in FIG. 4, is set toward the side of the leading end of the covered electric wire 11, that is, toward the side of the contact portion 12.

The pressure-contact blades 17 are not connected to the side wall portions 16 except the connecting portions 20 thereof and, for this reason, the angle thereof with respect to the side wall portions 16 can be changed with the connecting portions 20 thereof used as the center thereof. This angle change, as will be discussed later, is made in a direction where the inclination angle increases.

Now, the clamping portion 14 is composed of a pair of clamping pieces 21 which are so formed as to stand up from the bottom wall portion 15 and, as shown in FIG. 3, if the clamping pieces 21 are bent and clamped, then the clamping portion 14 can fix the covered electric wire 11.

By the way, the covered electric wire 11, as shown in FIG. 4, includes a core 18 formed of a conductive metal wire and a covering portion 22 which is formed of insulating resin and covers the core 18.

Next, description will be given below of a method for connecting the covered electric wire 11 to the pressure-contact terminal 10. That is, at first, the covered electric wire 11 is inserted between the side wall portions 16 of the pressure-contact terminal 10 held in a state shown in FIG. 1 using a pressure-contact jig or the like. Due to such insertion of the covered electric wire 11, the mutually opposed pressure-contact blades 17 are pressure-contacted with the covered electric wire 11, so that, as shown in FIG. 4, they bite the covering portion 22 of the covered electric wire 11 and can be thereby contacted with the core 18 located inwardly of and covered with the covering portion 22 from both sides thereof, thereby being able to achieve conduction.

After the pressure-contact blades 17 bite the covering portion of the covered electric wire 11, the covered electric wire 11 is pulled in the backward direction shown by an arrow G in FIG. 5. That is, by pulling the covered electric wire 11 in the backward direction, a pulling force in the same direction is transmitted from the covered electric wire 11 to the pressure-contact blades 17 biting the covered electric wire 11. Due to this, as shown by chained lines in FIG. 5, the pressure-contact blades 17 are caused to stand up from their inclined states in a direction at right angles to their respective side wall portions 16, so that the angles of the pressure-contact blades 17 are caused to change.

That is, the angles of the pressure-contact blades 17 are changed in a direction where the inclination angles θ thereof with respect to their respective side wall portions 16 increase. This angle change reduces the width of the pressure-contact slot between the two pressure-contact blades 17. In more particular, as shown in FIG. 5, in a case where the diameter of the core 18 is a dimension A and, when the pressure-contact blades 17 bite the covered electric wire 11 simply by pressure-contact without pulling the covered electric wire 11, the pressure-contact slot provides a dimension B, there is obtained a relationship, A>B; and, when the covered electric wire 11 is pulled in the backward direction to thereby increase the angles of the pressure-contact blades 17 and reduce the width of the pressure-contact slot, there is obtained a relationship with respect to a dimension C of the pressure-contact slot, A>B>C.

Due to this, the pressure-contact blades 17 are able to hold the core 18 strongly between them, which makes it possible to prevent the core 18 from slipping off the pressure-contact blades 17 as well as shifting out of position. Also, the pressure-contact blades 17 are allowed to increase their contact load with respect to the core 18, thereby being able to achieve electrically stable connection between the core 18 and pressure-contact blades 17. Further, due to the fact that the angles of the pressure-contact blades 17 can be changed after manufacture of the pressure-contact terminal, the pressure-contact blades 17 are hardened to thereby be able to stabilize their contact load with respect to the core 18.

After the angles of the pressure-contact blades are changed in this manner, while the covered electric wire 11 remains pulled in the backward direction, the covered electric wire 11 is fixed by clamping the clamping pieces 21. This fixation of the covered electric wire 11 removes the mutual displacement between the covered electric wire 11 and pressure-contact terminal 10, and the angles of the pressure-contact blades 17 remain increased. Due to this, the pressure-contact blades 17 not only can hold the core 18 strongly between them but also can keep their large contact load state with respect to the core 18, thereby being able to keep a reliable connection state.

Therefore, according to the illustrated embodiment, although the pressure-contact terminal is simple in structure, since the pressure-contact blades 17 can be surely contacted with the core 18 of the covered electric wire 11, electric reliability can be improved.

As has been described heretofore, with use of a pressure-contact terminal according to the invention, by changing greatly the angles of the pressure-contact blades biting the covered electric wire, the pressure-contact blades are able to hold the core of the covered electric wire strongly between them and also can be contacted with the core of the covered electric wire with a high contact load. This eliminates the need for employment of a complicated structure to thereby be able to improve the electric reliability of the pressure-contact terminal.

With use of a connecting method according to the invention, not only the angles of the pressure-contact blades can be increased by pulling the covered electric wire while the pressure-contact blades are biting the covered electric wire to thereby be able to hold the core of the covered electric wire strongly between the pressure-contact blades, but also the clamping portion of the pressure-contact terminal is clamped to fix the covered electric wire to thereby be able to keep the strongly holding condition of the core, so that the pressure-contact terminal can be connected to the covered electric wire with high reliability.

What is claimed is:

1. A pressure-contact terminal comprising:

a pair of side wall portions between which an electrical wire is insertable, said electrical wire having a core covered with an insulating covering portion; and pressure-contact blades are respectively formed from said side wall portions to create an angle of less than 90 degrees between said side wall portions and said pressure-contact blades, such that when the electrical wire is pulled in a direction opposite to a leading end portion of the electrical wire, a width of a pressure-contact slot between said pressure contact blades is reduced, wherein said pressure-contact blades bite into said insulation covering portion of said electrical wire when said electrical wire is pressure-contacted between said pressure-contact blades, thereby creating contact between said pressure-contact blades and said electrical wire core.

2. The pressure-contact terminal as set forth in claim 1, wherein said pressure-contact blades include at least one pair of pressure-contact blades on opposing sides of said side wall portions.

3. The pressure-contact terminal as set forth in claim 1, wherein said pressure-contact blades are respectively inclined toward said leading end portion of said electrical wire inserted between said side wall portions, and the angles formed between said pressure-contact blades and said side wall portions are changeable by pulling said electrical wire in the direction opposite to said leading end portion.

4. The pressure-contact terminal as set forth in claim 1, wherein the angle formed between said pressure-contact blades and said side wall portions is changeable.

5. The pressure-contact terminal as set forth in claim 4, wherein the angle formed between said pressure-contact blades changes is increased.

6. A method of connecting a pressure-contact terminal and an electrical wire to each other, comprising the steps of:

(a) inserting an electrical wire between a pair of side wall portions of said pressure-contact terminal, having pressure-contact blades formed therefrom, wherein said pressure contact blades are angled with respect to said side wall portions, enabling the pressure-contact blades to bite into the electrical wire;

(b) pulling said electrical wire in a direction opposite to a leading end portion of said electrical wire, thereby changing the angles formed between said pressure-contact blades and said side wall portions to firmly grip the electrical wire by reducing the width of a pressure-contact slot between the pressure-contact blades; and (c) clamping a clamping portion of said pressure-contact terminal while said electrical wire remains pulled in the direction opposite to said leading end portion of said electrical wire, thereby fixing said electrical wire to said pressure-contact terminal.

7. The method of connecting a pressure-contact terminal according to claim 6, wherein the electrical wire of step (a) comprises a core covered by an insulating portion.

* * * * *